United States Patent [19]

Muratsuka

[11] 4,138,182

[45] Feb. 6, 1979

[54] PIN TYPE JACK-AND-PLUG COUPLING DEVICE

[75] Inventor: Hiroshi Muratsuka, Tokyo, Japan

[73] Assignee: Trio Kabushiki Kaisha, Tokyo, Japan

[21] Appl. No.: 807,130

[22] Filed: Jun. 16, 1977

[51] Int. Cl.[2] ..... H01R 13/54; H01R 17/18

[52] U.S. Cl. ..... 339/89 M; 339/183

[58] Field of Search ..... 339/89, 183, 217 J

[56] References Cited

U.S. PATENT DOCUMENTS

| | | | |
|---|---|---|---|
| 2,829,358 | 4/1958 | Testori | 339/89 M X |
| 3,233,202 | 2/1966 | Kyle | 339/89 R X |
| 3,445,805 | 5/1969 | McLoad | 339/89 R |
| 3,613,048 | 10/1971 | Brundza | 339/89 R |
| 3,808,580 | 4/1979 | Johnson | 339/89 R |
| 4,066,314 | 1/1978 | Williams | 339/89 R |

*Primary Examiner*—Roy Lake
*Assistant Examiner*—E. F. Desmond
*Attorney, Agent, or Firm*—Lane, Aitken and Ziems

[57] ABSTRACT

A pin type jack-and-plug coupling device is joined together by inserting the pin plug of a male connector into the pin jack of a female connector. The male connector has a captivated nut member and the female connector has an externally threaded member engageable with the nut member. After the pin plug has been inserted in the pin jack for electrical connection, the nut member is turned for threaded connection with the externally threaded member, whereupon the male and female connectors are lockingly joined together. The male connector also has a retainer nut for fastening the tightened nut member to prevent loosening.

4 Claims, 2 Drawing Figures

PIN TYPE JACK-AND-PLUG COUPLING DEVICE

BACKGROUND OF THE INVENTION

The present invention relates to electrical coupling or connector devices.

Pin type plug-and-jack connectors or couplings are widely used to join electric wires, conductors, lines, and cables and the like such as used for connecting audio equipment, communication equipment, electrical instruments, and similar apparatus. Prior art connectors can be quickly connected simply by inserting the pin plug into the pin jack. When such connectors are subjected to a mechanical pull, however, the pin plug may disengage from the pin jack because the pin plug is retained in position merely by frictional engagement with the pin jack.

SUMMARY OF THE INVENTION

According to the invention, a tightening means is provided for locking an inserted pin plug against removal from a pin jack. The tightening means includes an externally threaded hollow cylinder fixed around the pin jack and an internally threaded hollow cylinder disposed rotatably around but axially captivated on the pin plug. After the pin plug has been inserted in the pin jack, the internally threaded hollow cylinder is rotated to engage the externally threaded hollow cylinder to thereby prevent accidental disengagement of the pin plug. A means is provided to retain the internally threaded hollow cylinder in positively locking engagement with the externally threaded hollow cylinder to prevent loosening therefrom.

Accordingly, it is an object of the present invention to provide an improved connector or coupling device.

Another object of the present invention is to provide a pin type plug-and-jack coupling which can be held together against accidental disengagement.

The invention, together with its various features and advantages, can be understood with reference to the following more detailed description taken in conjunction with the accompanying drawings.

DETAILED DESCRIPTION OF THE PREFERRED EMBODIMENTS

Figure 1:
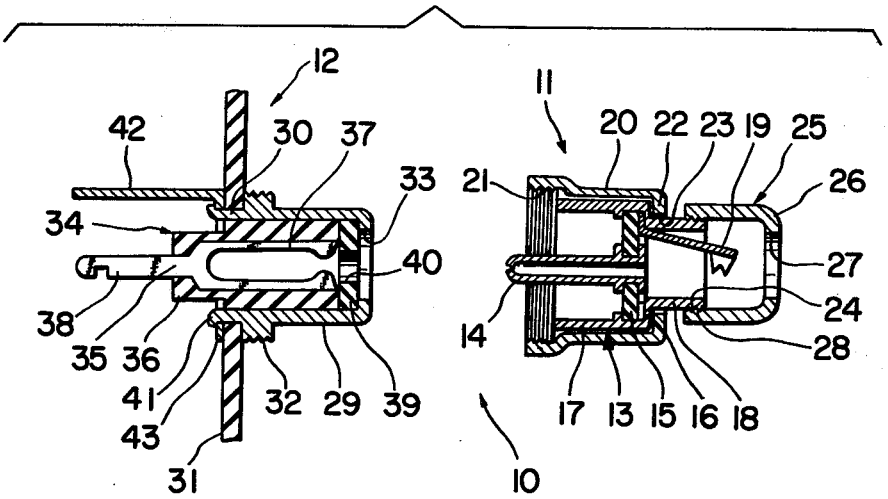
FIG. 1 is a vertical cross-sectional view of a pin type plug-and-jack coupling constructed in accordance with the present invention.
Figure 2:
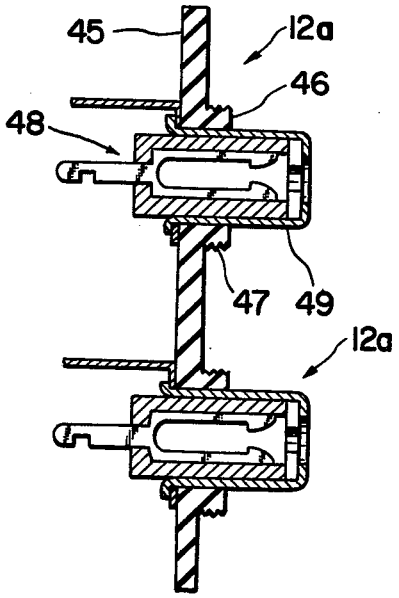
FIG. 2 is a vertical cross-sectional view showing a pair of modified pin jack connectors.

A pin type plug-and-jack connector or coupling according to the present invention is generally indicated by the numeral 10 in FIG. 1. The connector 10 includes a first mating member or male connector 11 and a second mating member or female connector 12.

The male connector 11 has a sleeve 13 acting as a ground conductor and a coaxial pin plug or pin connecting member 14 supported in the sleeve 13 by an insulating disk 15 mounted fixedly within the sleeve 13. The sleeve 13 has a central annular shoulder 16 that divides the sleeve 13 into a large-diameter portion 17 and a small-diameter portion 18. The sleeve 13 carries a terminal 19 having one end sandwiched between the insulator disk 15 and the annular shoulder 16 and the other end extending through the small-diameter portion 18 outwardly from the sleeve 13. A two wire electrical cable or wire pair (not shown) may be connected so that the ground wire is connected to terminal 19 and the signal or hot wire to the pin plug 14 by soldering, for example.

A hollow cylindrical or nut member 20 is disposed rotatably around the large-diameter portion 17 of the sleeve 13 and has internal threads 21 therein. The nut member 20 has an annular flange 22 remote from the internal threads 21. The annular flange 22 fits loosely over the small-diameter portion 18 of the sleeve 13 and defines an aperture 23 having a diameter smaller than an outside diameter of the portion 17 of the sleeve 13. The small-diameter portion 18 has external threads 24 thereon.

A retainer 25 includes a hollow cylinder 26 having a coaxial hole 27 through which electrical conductors (not shown) may extend. The cylindrical retainer 25 has internal threads 28 therein remote from the hole 27. The internal threads 28 engage the external threads 24 on the small-diameter portion 18. The cylindrical retainer 25 has an outside diameter larger than the diameter of the aperture 23. Thus, the annular flange 22 of the member 20 is axially captivated or trapped between the annular shoulder 16 and the retainer nut 25.

The female connector 12 includes a hollow cylindrical member 29 acting as a ground conductor and fixed at its mounting neck 30 to an insulator base plate 31. The member 29 has external threads 32 thereon near the mounting neck 30, and a coaxial end opening 33 remote from the mounting 30. The external threads 32 are adapted to engage the internal threads 21 in the member 20 of the male connector 11. The portion of the member 29 which is not externally threaded has an outside diameter which is substantially the same as an inside diameter of the large-diameter portion 17 of the sleeve 13. Thus, when the male and female connectors 11 and 12 are matingly engaged or coupled together, the cylindrical member 29 makes electrical contact with the sleeve 13.

Mounted coaxially in the member 29 is a pin jack or pin connecting member 34 having a signal or hot terminal 35 and an insulator bushing 36 surrounding the terminal 35. The terminal 35 includes a bifurcated portion 37 positioned within the member 29 and a terminal extension 38 extending outwardly from the member 29. An insulator spacer 39 is interposed between the pin jack 34 and the annular end flange which bounds the opening 33. The spacer 39 has a central opening 40 concentric with the opening 33, the openings 33 and 40 being receptive therethrough of the pin plug 14 of the male connector 11.

The mounting neck 30 of the member 29 has a distal annular end 41 projecting beyond the base plate 31. A terminal 42 has an attachment ring 43 placed around the distal annular end 41 and pressed against the base plate 31 with the annular end 41 staked or deformed radially outwardly. A two wire electrical cable or wire pair (not shown) may, for example, have the ground wire connected with the terminal 42 and the signal or hot wire connected to the terminal extension 38 of the hot terminal 35.

In order to join the male and female connectors 11 and 12 together in mating engagement, the pin plug 14 is first inserted through the openings 33 and 40 into the bifurcated portion 37 of the pin jack 34. The large-diameter portion 17 of the sleeve 13 should then fit partly over the non-threaded portion of the cylindrical member 29. Thus, the pin plug 14 and the pin jack 34 are electrically connected, and the sleeve 13 and the cylindrical member 29 are electrically connected. The nut member 20 is then urged toward the member 29 and turned around the sleeve 13 until the internal threads 21 engage the external threads 32 of the cylindrical member 29. As the nut member 20 is then further rotated, it is advanced toward the cylindrical member 29 by progressive inter-engagement between the internal and external threads 21 and 32. When the nut member 20 is fully threaded onto the cylindrical member 29, the large-diameter portion 17 of the sleeve 13 fits fully over the non-threaded portion of the member 29 and the sleeve 13 is prevented from removal by the annular flange 22 of the nut member 20 which lockingly engages the annular shoulder 16 of the sleeve 13. The male and female connectors 11 and 12 are then mechanically and electrically coupled together positively. To prevent loosening of the nut member 20, the retainer nut 25 is turned around the small-diameter portion 18 of the sleeve 13 until the front end of the retainer nut 25 abuts against the annular flange 22 of the nut member 20, thereby fastening the annular flange 22 against the annular shoulder 16 in a lock-nut fashion.

According to a modified pin jack connector 12*a*, an insulator base plate 45 has a hollow cylindrical member 46 integral therewith, the member 46 having external threads 47 thereon. The base plate 45 supports a pin jack 48 extending through the cylindrical member 46 transversely of the base plate 45, with a cylindrical member 49 between the cylindrical member 46 and the pin jack 48.

It is noted that the female connectors 12 or 12*a* can also be used with a conventional pin plug connector having no tightening nut. For connection in such a case, the pin plug of a conventional male connector is inserted into the female connector 12 or 12*a* with its sleeve fitting over the non-threaded portion of the cylindrical member 29 or 49.

It is to be understood that various changes and modifications may be made by those skilled in the art without departing from the scope of the appended claims.

What is claimed is:

1. A coupling device comprising:

a first mating member having a first pin connecting member;

a second mating member having a second pin connecting member, said first and second mating members being adapted to be joined together by inserting said first pin connecting member into said second pin connecting member;

means for tightening said first and second mating members together through a threaded connection after they have been joined comprising a first hollow cylindrical member fixed around one of said mating members and having external threads thereon and a second hollow cylindrical member disposed rotatably around but captivated on the other of said mating members and having internal threads therein which are adapted to engage said external threads; and means for releaseably retaining said tightening means lockingly in place comprising a third hollow cylindrical member having internal threads therein, said other mating member having an annular shoulder and external threads thereon adapted to engage said internal threads in said third cylindrical member, and said second cylindrical member having an annular flange adapted to be releaseably locked between said annular shoulder and said third cylindrical member.

2. A coupling device according to claim 1, further comprising a base plate supporting said second mating member and extending transversely therethrough and wherein said first hollow cylindrical member is integral with said base plate.

3. A coupling device according to claim 1 wherein said third cylindrical member is adapted to allow an insulated electrical conductor to extend through an opening therein for electrical connection to said pin connecting member within said other mating member.

4. A coupling device according to claim 3 wherein said third cylindrical member is adapted to be unthreaded and removed from said other mating member to facilitate the connecting of the insulated electrical conductor to said pin connecting member within said other mating member.

* * * * *